US008204262B2

(12) United States Patent
Aoyagi

(10) Patent No.: US 8,204,262 B2
(45) Date of Patent: Jun. 19, 2012

(54) SOUND IMAGE LOCALIZATION PROCESSOR, METHOD, AND PROGRAM

(75) Inventor: Hiromi Aoyagi, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 516 days.

(21) Appl. No.: 12/312,253

(22) PCT Filed: Feb. 18, 2008

(86) PCT No.: PCT/JP2008/052619

§ 371 (c)(1),
(2), (4) Date: May 1, 2009

(87) PCT Pub. No.: WO2008/111362

PCT Pub. Date: Sep. 18, 2008

(65) Prior Publication Data

US 2010/0080396 A1 Apr. 1, 2010

(30) Foreign Application Priority Data

Mar. 15, 2007 (JP) ..... 2007-066563

(51) Int. Cl.
*H04R 5/02* (2006.01)

(52) U.S. Cl. ..... 381/310; 381/309; 381/74; 381/300; 381/306; 381/307

(58) Field of Classification Search ..... 381/17, 381/18, 310, 309, 74, 300, 306, 307
See application file for complete search history.

(56) References Cited

U.S. PATENT DOCUMENTS 5,598,478 A 1/1997 Tanaka et al.
2001/0040968 A1 * 11/2001 Mukojima ..... 381/17

FOREIGN PATENT DOCUMENTS

| | | |
|---|---|---|
| JP | H4-061500 | 2/1992 |
| JP | H6-245300 | 9/1994 |
| JP | 6-315200 A | 11/1994 |
| JP | 8-079900 A | 3/1996 |
| JP | H10-174200 | 6/1998 |
| JP | 2002-005675 A | 1/2002 |

OTHER PUBLICATIONS

Yasuyo Yasuda and Tomoyuki Oya, "Reality Voice and Sound Communication Technology", NTT Technical Journal (NTT Gijutsu Janaru), vol. 15, No. 9, Telecommunications Association, Sep. 2003, pp. 71-75.

* cited by examiner

*Primary Examiner* — Tom Thomas
*Assistant Examiner* — Benjamin Tzu-Hung Liu
(74) *Attorney, Agent, or Firm* — Rabin & Berdo, P.C.

(57) ABSTRACT

There are provided: a means (101*a*) for storing standard head related transfer functions for reference positions from a virtual listener; a means (101) for, when given information (DIR, DIST) about a virtual sound source position, forming head related transfer functions (hL(k), hR(k)) as left ear and right ear head related transfer functions by selecting one of the stored standard head related transfer functions or by selecting two or more of them and interpolating; means (102, 103) for imprinting a sense of direction and distance on the audio listening signal by using the head related transfer functions thus obtained; and means (104, 105) for correcting a distance related to the obtained head related transfer functions and the sense of distance to the virtual sound source position, in the audio listening signals (sL(n), sR(n)) given the sense of direction and distance or the source audio listening signal (s(n)). A highly precise sense of distance can be provided in a small structure.

19 Claims, 8 Drawing Sheets

SOUND IMAGE LOCALIZATION PROCESSOR, METHOD, AND PROGRAM

FIELD OF THE INVENTION

The present invention relates to a sound image localization processor, method, and program that can be used for sound image localization in, for example, a sound output device.

BACKGROUND ART

A person recognizes the direction of and distance to a sound source from the difference between the sound heard by the left and right ears. The difference between the sound heard by the left and right ears arises from the different distances from the sound source to the left and right ears, that is, the different characteristics (frequency characteristics, phase characteristics, loudness, etc.) imprinted on the sound as it propagates through space. By intentionally imparting a difference in these characteristics to a sound-source signal, it is possible to have the signal recognized as coming from an arbitrary direction and distance. A head related transfer function (HRTF) is a well-known way to represent the characteristics acquired by a sound source during propagation to the ears. By measuring the HRTFs froth a virtual sound source to the ears and then imparting these characteristics to a signal, it can be made to seem that a sound is being heard from the virtual sound source. In principle the virtual sound source may be disposed at any location, provided HRTFs can be obtained for all points in space, but this is impractical because of restrictions on structural size, such as the amount of hardware. To deal with this problem, in the 'virtual sound source control server' described in Non-Patent Document 1, many HRTFs are obtained from few HRTFs by interpolation.

Non-Patent Document 1: Yasuyo YASUDA and Tomoyuki OYA, 'Reality Voice and Sound Communication Technology', *NTT Technical Journal* (NTT Gijutsu Janaru), Vol. 15, No. 9, Telecommunications Association, September 2003.

SUMMARY OF THE INVENTION

However, although the virtual sound source control server described above can interpolate HRTFs with respect to direction, for distance it can only adjust the sound volume. Adjusting only the sound volume is not adequate for control of the sense of distance.

It would be desirable to have a sound image localization processor, method, and program that can provide a highly precise sense of distance in a small structure.

A novel sound image localization processor that, when given a source audio listening signal to be listened to by a listener and information about a virtual sound source position referenced to the listener's position, imprints a sense of direction and a sense of distance on the audio listening signal such that it sounds to the listener as if sound based on the audio listening signal comes from the virtual sound source position includes:

a standard head related transfer function storage means for storing standard head related transfer functions for a plurality of reference positions located in one or more directions from a virtual listener;

a head related transfer function generation means for, when given the information about the virtual sound source position, forming a left ear head related transfer function for the virtual sound source position by selecting one of the stored standard head related transfer functions or selecting a plurality of the stored standard head related transfer functions and interpolating, and for forming a right ear head related transfer function for the virtual sound source by selecting one of the stored standard head related transfer functions or selecting a plurality of the stored standard head related transfer functions and interpolating;

a sense-of-direction-and-distance imprinting means for imprinting a sense of direction and distance on the source audio listening signal by using the left ear and right ear head related transfer functions obtained by the head related transfer function generation means; and a sense-of-distance correction means for correcting the sense of distance of a left ear audio listening signal output from the sense-of-direction-and-distance imprinting means or the source audio listening signal input to the sense-of-direction-and-distance imprinting means, responsive to a distance from a left ear position to a position corresponding to the left-ear head related transfer function obtained by the head related transfer function generation means and a distance from the left ear position to the virtual sound source position, and for correcting the sense of distance of a right ear audio listening signal output from the sense-of-direction-and-distance imprinting means or the source audio listening signal input to the sense-of-direction-and-distance imprinting means, responsive to a distance from the right ear position to a position corresponding to the right-ear head related transfer function obtained by the head related transfer function generation means and a distance from the right ear position to the virtual sound source position.

A novel sound image localization processing program, when given a source audio listening signal to be listened to by a listener and information about a virtual sound source position referenced to the listener's position, imprints a sense of direction and a sense of distance on the audio listening signal such that it sounds to the listener as if sound based on the audio listening signal comes from the virtual sound source position, by making a computer furnished with sound output apparatus function as:

a standard head related transfer function storage means for storing standard head related transfer functions for a plurality of reference positions located in one or more directions from a virtual listener;

a head related transfer function generation means for, when given the information about the virtual sound source position, forming a left ear head related transfer function for the virtual sound source position by selecting one of the stored standard head related transfer functions or selecting a plurality of the stored standard head related transfer functions and interpolating, and for forming a right ear head related transfer function for the virtual sound source by selecting one of the stored standard head related transfer functions or selecting a plurality of the stored standard head related transfer functions and interpolating;

a sense-of-direction-and-distance imprinting means for imprinting a sense of direction and distance on the source audio listening signal by using the left ear and right ear head related transfer functions obtained by the head related transfer function generation means; and a sense-of-distance correction means for correcting the sense of distance of a left ear audio listening signal output from the sense-of-direction-and-distance imprinting means or the source audio listening signal input to the sense-of-direction-and-distance imprinting means, responsive to a distance from a left ear position to a position corresponding to the left-ear head related transfer function obtained by the head related transfer function generation means and a distance from the left ear position to the virtual sound source position, and for correcting the sense of distance of a right ear audio listening signal output from the sense-of-direction-and-distance imprinting means or the source audio listening signal input to the sense-of-direction-and-distance imprinting means, responsive to a distance from the right ear position to a position corresponding to the right-ear head related transfer function obtained by the head related transfer function generation means and a distance from the right ear position to the virtual sound source position.

A novel sound image localization processing method that, when given a source audio listening signal to be listened to by a listener and information about a virtual sound source position referenced to the listener's position, imprints a sense of direction and a sense of distance on the audio listening signal such that it sounds to the listener as if sound based on the audio listening signal comes from the virtual sound source position comprises:

storing, by a standard head related transfer function storage means, standard head related transfer functions for a plurality of reference positions located in one or more directions from a virtual listener;

when given the information about the virtual sound source position, forming, by a head related transfer function generation means, a left ear head related transfer function for the virtual sound source position by selecting one of the stored standard head related transfer functions or selecting a plurality of the stored standard head related transfer functions and interpolating, and forming a right ear head related transfer function for the virtual sound source by selecting one of the stored standard head related transfer functions or selecting a plurality of the stored standard head related transfer functions and interpolating;

imprinting, by a sense-of-direction-and-distance imprinting means, a sense of direction and distance on the source audio listening signal by using the left ear and right ear head related transfer functions obtained by the head related transfer function generation means; and by a sense-of-distance correction means, correcting the sense of distance of a left ear audio listening signal output from the sense-of-direction-and-distance imprinting means or the source audio listening signal input to the sense-of-direction-and-distance imprinting means, responsive to a distance from a left ear position to a position corresponding to the left-ear head related transfer function obtained by the head related transfer function generation means and a distance from the left ear position to the virtual sound source position, and correcting the sense of distance of a right ear audio listening signal output from the sense-of-direction-and-distance imprinting means or the source audio listening signal input to the sense-of-direction-and-distance imprinting means, responsive to a distance from the right ear position to a position corresponding to the right-ear head related transfer function obtained by the head related transfer function generation means and a distance from the right ear position to the virtual sound source position.

The present invention can provide a sound localization processor that is small in structure but can give a highly precise sense of distance.

Detailed Description of the Invention

100 sound image localization processor, 101 HRTF generator, 101*a* standard HRTF storage unit, 102 left ear signal generator, 103 right ear signal generator, 104 left ear signal adjuster, 104*a* gain adjuster, 105 right ear signal adjuster, 105*a* gain adjuster (A) First Embodiment A first embodiment of the sound image localization processor, method, and program of the present invention will be described with reference to the drawings below.

(A-1) Structure of the First Embodiment

Figure 1:
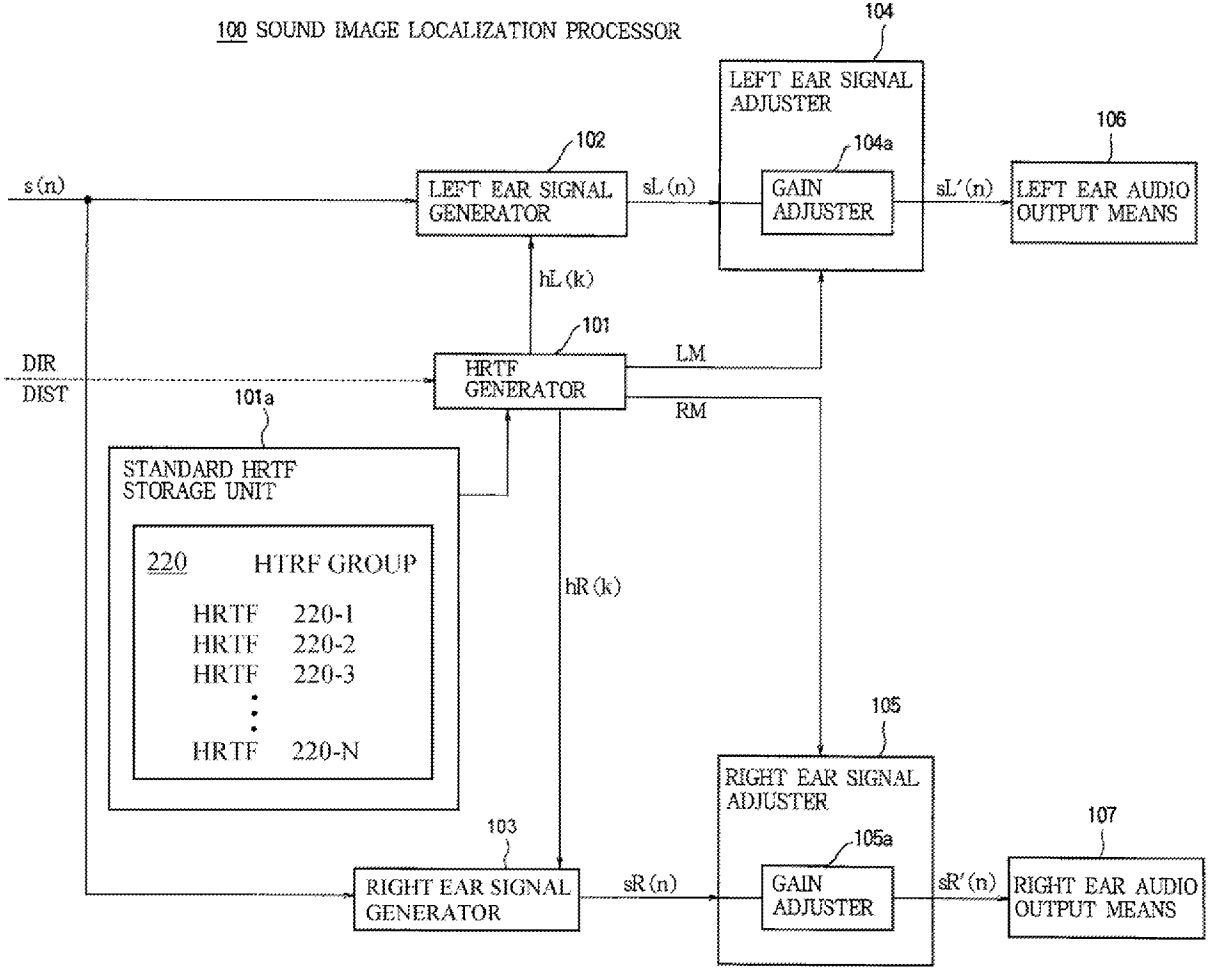
FIG. 1 is a block diagram showing the overall structure of the sound image localization processor in a first embodiment.

FIG. 1 is a block diagram showing the overall structure of the sound image localization processor in the first embodiment.

When given a sound-source signal or a source audio listening signal s(n) on which a sense of direction and distance is to be imprinted, with information DIR about the desired direction ('DIF is used below to indicate both the direction information and the direction itself) and information DIST about the desired distance (DIST' is used below to indicate both the distance information and the distance itself), a sound image localization processor 100 imprints a sense of direction and a sense of distance on the signal denoted s(n) such that it sounds to the listener as if sound produced by the signal s(n) comes from a virtual position (virtual sound-source position) given by the direction DIR and the distance DIST, and outputs the signal to a means of providing audio output to the listener, such as, for example, a pair of headphones.

The sound image localization processor 100 imprints a sense of direction and distance on the signal s(n), generates a left ear audio listening signal (denoted sL(n) below) and a right ear audio listening signal (denoted sR(n) below), and performs a further sense-of-distance adjustment on sL(n) and sR(n) to generate a left ear adjusted audio listening signal (denoted sL'(n) below) and a right ear adjusted audio listening signal (denoted sR'(n) below). In the sound image localization processor 100, for example, if the audio output means is headphones, sL'(n) and sR'(n) are supplied to the left and right speakers, respectively.

The left signal sL'(n) and the right signal sR'(n) are thus generated from the same signal s(n).

The sound image localization processor 100 may be configured by installing the sound image localization program of the embodiment in a computer configured as a softphone, e.g., in an information processing terminal such as a personal computer, or installing it in another telephone terminal having a program-operated structure, such as a mobile phone terminal or an IP phone terminal. The sound image localization processor 100 may also be built into, for example, a mobile phone terminal or an IP phone terminal so that if a direction DIR and a distance DIST are given according the state of a call or a manual operation by the caller, a sense of direction and distance is imparted to the voice signal. The sound image localization processor 100 may also be built into, for example, a videophone terminal so that if a direction DIR and a distance DIST are set through the videophone terminal according to conditions such as, for example, the other party's display position, a sense of direction and distance is imparted to the voice signal.

The sound image localization processor 100 comprises a standard HRTF storage unit 101*a*, an HRTF generator 101, a left ear signal generator 102, a right ear signal generator 103, a left ear signal adjuster 104, and a right ear signal adjuster 105. The outputs of the left ear signal adjuster 104 and the right ear signal adjuster 105 are supplied, respectively, to a left ear audio output means 106 and a right ear audio output means 107, each of which includes a speaker.

The standard HRTF storage unit 101*a* stores standard head related transfer functions (standard HRTFs) for a plurality of reference positions located in one or more directions from a virtual listener. The standard HRTFs for each reference position are transfer functions of a path from the relevant reference position to the virtual listener (defined as, for example, the middle position between the left and right ears).

The HRTF generator 101, when given direction information DIR and distance information DIST for a virtual sound source position, forms a left ear HRTF (denoted 'hL(k)' below) for the virtual sound source position by selecting one of the stored standard HRTFs or selecting a plurality of the stored standard HRTFs and interpolating, and forms a right ear HRTF (denoted 'hR(k)' below) for the virtual sound source by selecting one of the stored standard HRTFs or selecting a plurality of the stored standard HRTFs and interpolating. The function hL(k) is supplied to the left ear signal generator 102 and is used for generating the left ear audio listening signal sL(n). The function hR(k) is supplied to the right ear signal generator 103 and is used for generating the right ear audio listening signal sR(n).

Next, an exemplary structure for obtaining hR(k) and hL(k) in the HRTF generator 101 will be described.

The HRTF generator 101 is provided with a standard HRTF storage unit 101*a*.

Figure 2:
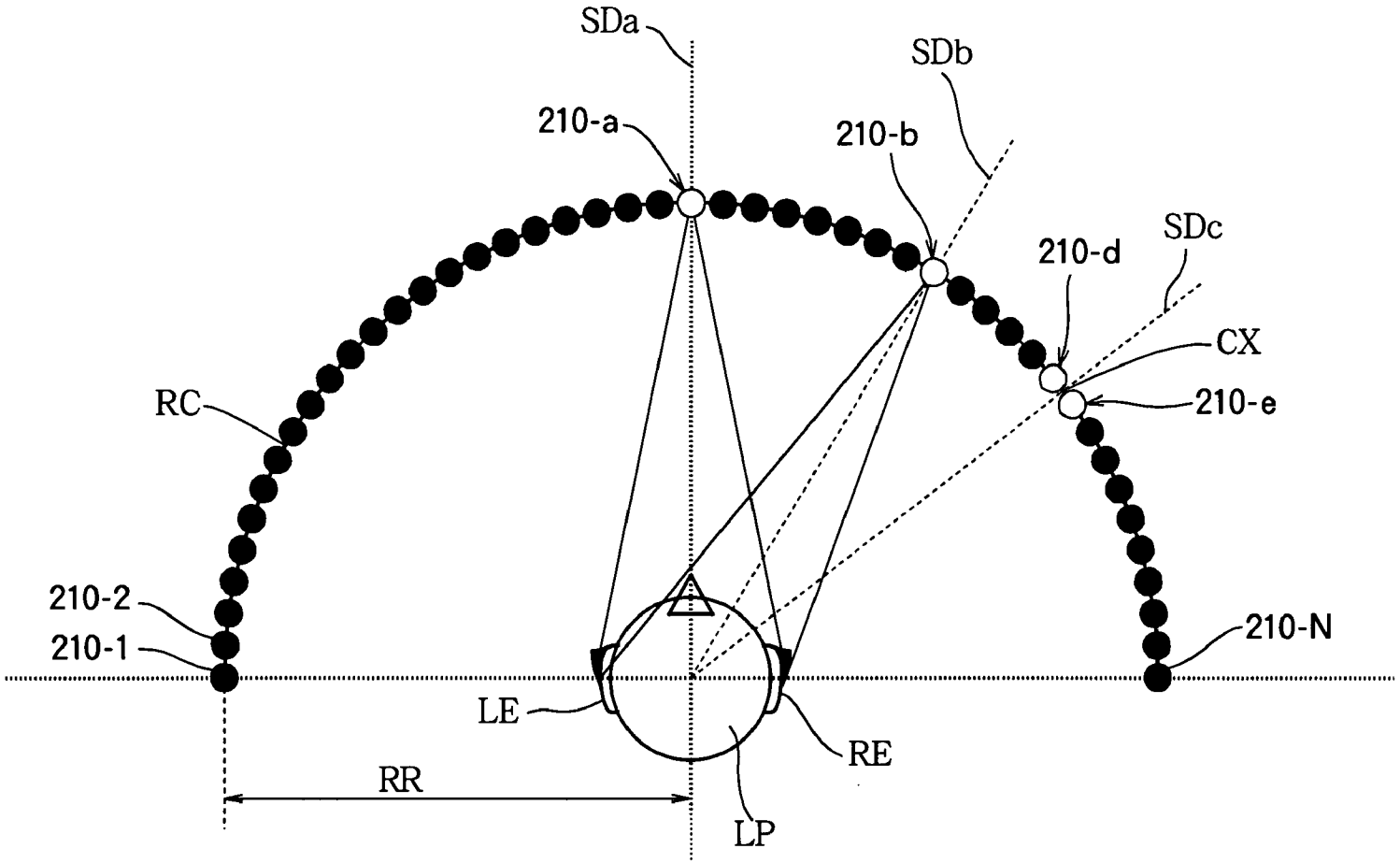
FIG. 2 is an explanatory diagram showing how HRTFs are determined in the first embodiment when the distance to the virtual sound source equals a standard distance.

The HRTF generator 101 is a storage means for storing, for example, a standard HRTF group 220 including a plurality of HRTFs 220-1, 220-2, . . . , 220-N for a plurality of reference positions 210-1, 210-2, . . . , 210-N located at an arbitrary distance (referred to below as the 'standard distance') from a virtual listener as shown in FIG. 2.

The HRTFs 220-1, 220-2, . . . , 220-N included in the standard HRTF group 220 correspond to the respective reference positions 210-1, 210-2, . . . , 210-N (indicated by white and black circles) shown in FIG. 2, which are disposed at equal intervals on a circle (standard distance circle) RC centered on the center of a listener LP (defined as the middle position between the left and right ears LE, RE of the listener LP) and having a standard distance RR as a radius; that is, they are transfer functions of paths from respective reference positions to the listener LP.

The standard HRTF group 220 may be stored in the standard HRTF storage unit 101*a* in the form of impulse responses, for example, or as infinite impulse response (IIR) filter coefficients or frequency-amplitude and frequency-phase characteristics.

FIG. 2 is an explanatory diagram showing how an HRTF is generated (selected or calculated) in the HRTF generator 101 when the distance DIST equals the standard distance RR.

When the distance DIST equals the standard distance RR, the relevant standard HRTFs are selected or calculated from the standard HRTF group 220 and output to the left ear signal generator 102 and right ear signal generator 103 as hL(k) and hR(k). When the direction DIR is the frontal direction of the listener LP (indicated by dotted line SDa) and the distance DIST equals the standard distance RR, for example, the standard HRTFs for a reference position 210-*a* (one of 210-1 to 210-N) located in front of the listener are selected from the standard HRTF group 220 as hL(k) and hR(k).

When the direction DIR is a direction other than the frontal direction SDa of the listener LP (an example is indicated by dotted line SDb) and the distance DIST equals the standard distance RR, the standard HRTFs for a reference position 210-*b* located in the direction SDb from the listener LP are selected from the standard HRTF group 220 as hL(k) and hR(k).

If there is no reference position in direction DIR, the standard HRTFs for the reference position closest to the position located in direction DIR may be selected or the HRTFs for the relevant position may be calculated (interpolated) from one or more standard HRTFs for reference positions disposed in a neighborhood of the position located in direction DIR.

In FIG. 2, for example, there is no reference position in direction SDc; the dotted line indicating direction SDc intersects circle RC at a point (intersection) CX located between two reference positions 210-*d*, 210-*e* (two of 210-1 to 210-N). In this case, interpolation is performed by using, for example, the standard HRTFs corresponding to the two reference positions 210-*d*, 210-*e* disposed on both sides of the intersection CX to obtain the HRTFs for the intersection CX.

Figure 3:
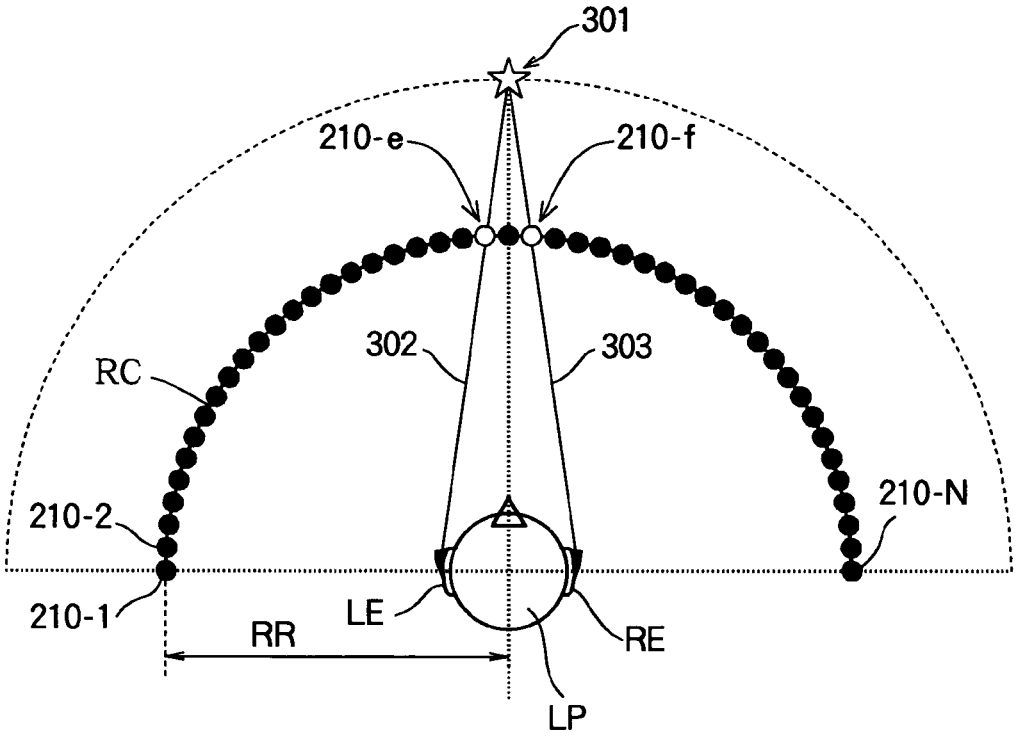
FIG. 3 is an explanatory diagram showing how HRTFs are determined in the first embodiment when the distance to the virtual sound source is longer than the standard distance.

FIG. 3 is an explanatory diagram showing how HRTFs are generated (selected or calculated) in the HRTF generator 101 when the distance DIST is longer than the standard distance RR.

Suppose, for example, that the position given by the direction DIR and distance DIST in the HRTF generator 101 is farther from the listener LP than the standard distance RR, as is the case for sound source point 301. In this case, as hL(k), the HRTF generator 101 supplies the left ear signal generator 102 with the HRTF 220-*e* for a reference position 210-*e* (one of the above 210-1 to 210-N) at the intersection of the standard distance circle RC with a line 302 connecting sound source point 301 and the listener's left ear LE. Similarly, as hR(k), the HRTF generator 101 supplies the right ear signal generator 103 with the HRTF 220-*f* (one of the above 220-1 to 220-N) for a reference position 210-*f* (one of the above 210-1 to 210-N) located at the intersection of the standard distance circle RC with a line 303 connecting sound source point 301 and the listener's right ear RE.

In this case, if there is no reference position (none of reference positions 210-1 to 210-N) at the intersection of circle RC with line 302 or 303, the standard HRTF for the reference position closest to the intersection may be selected and employed, or an HRTF for the intersection may be calculated (for example, by interpolation) from one or more standard HRTFs for reference positions disposed in a neighborhood of the intersection.

Figure 4:
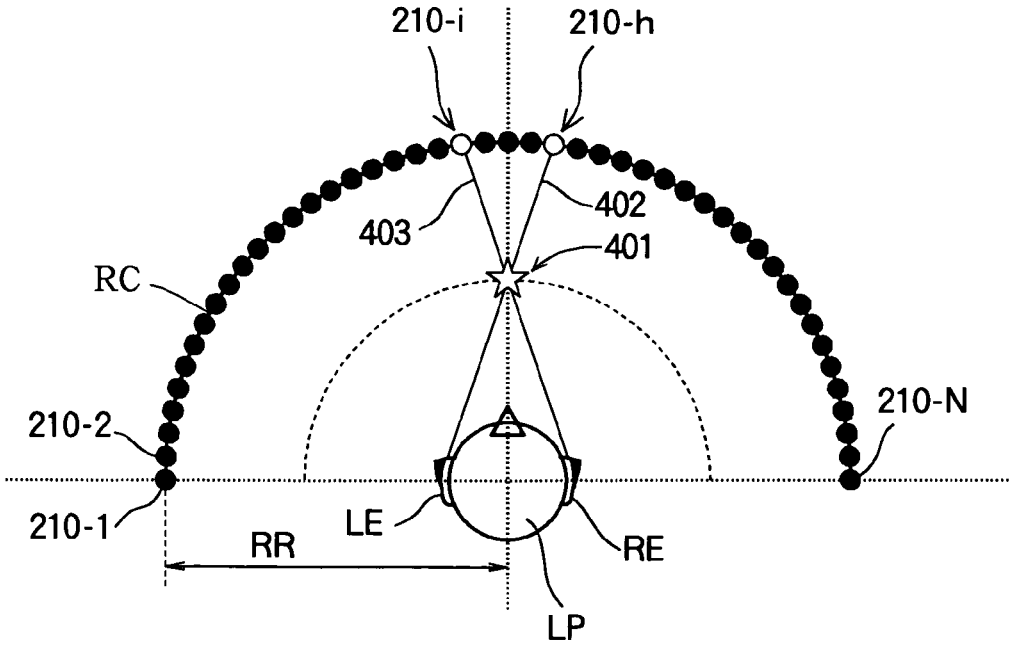
FIG. 4 is an explanatory diagram showing how HRTFs are determined in the first embodiment when the distance to the virtual sound source is shorter than the standard distance.

FIG. 4 is an explanatory diagram showing how the HRTF is selected in the HRTF generator 101 when the distance DIST is shorter than the standard distance RR.

Suppose, for example, that the position given by the direction DIR and distance DIST in the HRTF generator 101 is closer to the listener LP than the standard distance RR, as is the case for sound source point 401. In this case, as hL(k), the HRTF generator 101 supplies the left ear signal generator 102 with the HRTF 220-*h* (one of the above 220-1 to 220-N) for a reference position 210-*h* (one of the above 210-1 to 210-N) located at the intersection of the standard distance circle RC with the extension of a line 402 connecting the sound source point 401 and the listener's left ear LE. Similarly, as hR(k), the HRTF generator 101 supplies the right ear signal generator 103 with the HRTF 220-*i* (one of the above 220-1 to 220-N) for a reference position 210-*i* (one of the above 210-1 to 210-N) located at the intersection of the standard distance circle RC with the extension of a line 403 connecting the sound source point 401 and the listener's right ear RE.

In this case, if there is no reference position (none of reference positions 210-1 to 210-N) at the intersection of circle RC with line 402 or 403, the standard HRTF for the reference position closest to the intersection may be selected and employed, or an HRTF for the intersection may be calculated (for example, by interpolation) from one or more standard HRTFs for reference positions disposed in a neighborhood of the intersection.

The HRTF generator 101 also supplies, to the left ear signal adjuster 104 and right ear signal adjuster 105, information LM, RM necessary for signal adjustment, such as, for example, the distance from the positions of the listener's ears to the sound source point.

As the information LM necessary for left ear signal adjustment, for example, information representing the distance SLL from the left ear to the sound source point and information representing the distance RLL from the left ear to the position corresponding to the generated HRTF are given, or information representing the ratio (SLL/RLL) of these two distances or the difference (SLL−RLL) between the two distances is given.

The information describing the distance SLL from the left ear to the sound source point is obtained from the information DIR, DIST representing the direction and distance of the sound source point and information (a predetermined value) indicating the distance between the left and right ears.

As the information necessary for right ear signal adjustment, for example, information representing the distance SLR from the right ear to the sound source point and information representing the distance RLR from the right ear to a position corresponding to the generated HRTF are given, or information representing the ratio (SLR/RLR) of these two distances or the difference (SLR−RLR) between the two distances is given.

The information describing the distance SLR from the right ear to the sound source point is obtained from the information DIR, DIST representing the direction and distance of the sound source point and the information (a predetermined value) indicating the distance between the left and right ears.

When given the source audio listening signal s(n) and the left ear head related transfer function hL(k), the left ear signal generator 102 generates the left ear audio listening signal sL(n) from s(n) and hL(k) and supplies the generated sL(n) to the left ear signal adjuster 104.

In this case, if hL(k) is received from the HRTF generator 101 in impulse response form, sL(n) may be generated by convolving s(n) and hL(k). If hL(k) is received in the form of IIR filter coefficients, sL(n) may be generated by an IIR filter calculation. If hL(k) is received from the HRTF generator 101 in the form of frequency-amplitude and frequency-phase characteristics, sL(n) may be generated by performing a fast Fourier transform (FFT) process on s(n) to obtain power information for each frequency component, manipulating the amplitude and phase characteristics according to hL(k), and recovering a time-axis signal by inverse FFT processing.

Similarly, when given the source audio listening signal s(n) and the right ear head related transfer function hR(k), the right ear signal generator 103 generates the right ear audio listening signal sR(n) from s(n) and hR(k) and supplies sR(n) to the right ear signal adjuster 105.

The right ear signal generator 103 generates the right ear audio listening signal sR(n) in the same way as the left ear signal generator 102 generates the left ear audio listening signal sL(n), so a detailed description will be omitted.

The left ear signal generator 102 and right ear signal generator 103 constitute a sense-of-direction-and-distance imprinting means for using the left ear head related transfer function hL(k) obtained by the HRTF generator 101 to imprint a sense of direction and distance on the source audio listening signal s(n) and generate the left ear audio listening signal sL(n), and for using the right ear head related transfer function hR(k) obtained by the HRTF generator 101 to imprint a sense of direction and distance on the source audio listening signal s(n) and generate the right ear audio listening signal sR(n).

The left ear signal adjuster 104 adjusts the signal sL(n) generated by the left ear signal generator 102 according to the information LM provided from the HRTF generator 101, further correcting the sense of distance, to generate a left ear audio listening signal sL'(n) in which the sense of distance has been corrected, and outputs sL'(n) to the left ear audio output means 106. The left ear signal adjuster 104 includes a gain adjuster 104*a*.

When supplied with the information LM used for adjusting the left ear signal from the HRTF generator 101 and signal sL(n) from the left ear signal generator 102, gain adjuster 104*a* adjusts the gain of sL(n) according to the information LM provided from the HRTF generator 101 to generate the signal sL'(n). The gain adjustment in gain adjuster 104*a* may be carried out by, for example, comparing the distance SLL from the position of the listener's left ear to the sound source point with the distance RLL from the position of the listener's left ear to the position corresponding to the HRTF selected by the HRTF generator 101 and using, for example, the ratio (SLL/RLL) or difference (SLL−RLL) of these two distances.

The right ear signal adjuster 105 likewise adjusts the signal sR(n) generated by the right ear signal generator 103 according to the information RM provided from the HRTF generator 101, further correcting the sense of distance, to generate a right ear audio listening signal sR'(n) in which the sense of distance has been corrected, and outputs sR'(n) to the right ear audio output means 107. The right ear signal adjuster 105 includes a gain adjuster 105*a*.

The structure and operation of gain adjuster 105*a* are similar to the structure and operation of gain adjuster 104*a*, so a detailed description will be omitted.

The left ear signal adjuster 104 and the right ear signal adjuster 105 constitute a sense-of-distance correction means for performing a sense-of-distance correction on a left ear audio listening signal sL(n) output from the left ear signal generator 102, responsive to the distance RLL from the left ear position to the position corresponding to the left-ear HRTF obtained by the HRTF generator 101 and the distance SLL from the left ear position to the virtual sound source position, and for performing a sense-of-distance correction on the right ear audio listening signal sR(n) output from the right ear signal generator 103, responsive to the distance RLR from the right ear position to the position corresponding to the right-ear HRTF obtained by the HRTF generator 101 and the distance SLR from the right ear position to the virtual sound source position.

(A-2) Operation of the First Embodiment

Next, the operation of imprinting a sense of direction and distance carried out in the sound image localization processor 100 in the first embodiment having the above structure will be described.

If it is assumed that, for example, the sound image localization processor 100 is built into a mobile phone, information about the desired virtual sound source point, including the direction DIR and the distance DIST from the listener, is supplied to the HRTF generator 101 from the controller of the mobile phone (not shown). In this case, a voice signal in the mobile phone terminal is input to the left ear signal generator 102 and the right ear signal generator 103 as the source audio listening signal s(n).

Upon receiving the direction information DIR and distance information DIST, the HRTF generator 101 generates hL(k) and hR(k), based on the standard HRTF group 220 stored in the standard HRTF storage unit 101*a*, and supplies them to the left ear signal generator 102 and right ear signal generator 103, respectively.

Upon receiving hL(k), the left ear signal generator 102 generates sL(n) as a signal in which a sense of distance based on hL(k) is imprinted on the signal s(n) supplied from the mobile phone terminal, and outputs sL(n) to the left ear signal adjuster 104. Similarly, in the right ear signal generator 103, based on the given hR(k) and s(n), sR(n) is generated and output to the right ear signal adjuster 105.

Upon receiving the signal sL(n) from the left ear signal generator 102 and the information LM necessary for signal adjustment from the HRTF generator 101, the left ear signal adjuster 104 performs a gain adjustment on sL(n) according to the information LM supplied from the HRTF generator 101 and generates sL'(n), which is output to a left ear audio output means 106 such as a headphone or the like.

Similarly, the right ear signal adjuster 105 performs a gain adjustment on the given sR(n) and generates sR'(n), which is output to the right ear audio output means 107.

(A-3) Effect of the First Embodiment

According to the first embodiment, it is possible to achieve the following effects.

Even when the sound source point given by the direction DIR and distance DIST referenced to the listener is not located on the standard distance circle RC, the HRTF generator 101 in the sound image localization processor 100 of the first embodiment can obtain HRTFs corresponding to the sound source point for the listener's left and right ears by using only the standard HRTF group 220 including standard HRTFs for reference positions having the standard distance RR. This makes it possible to obtain an HRTF corresponding to an arbitrary position from the listener without storing HRTFs for all positions in the space surrounding the listener. Accordingly, a sound localization processor can be provided that is small in structure but can give a highly precise sense of distance.

Furthermore, a left ear signal adjuster 104 and right ear signal adjuster 105 are provided in the sound image localization processor 100 of the first embodiment to perform gain adjustments on the signals sL(n), sR(n) depending on, for example, the distance from the positions of the listener's ears to the sound source point, thereby enabling a more highly precise sense of distance to be given.

(B) Second Embodiment

A second embodiment of the sound image localization processor, method, and program of the present invention will be described below with reference to the drawings.

(B-1) Structure of the Second Embodiment

Figure 5:
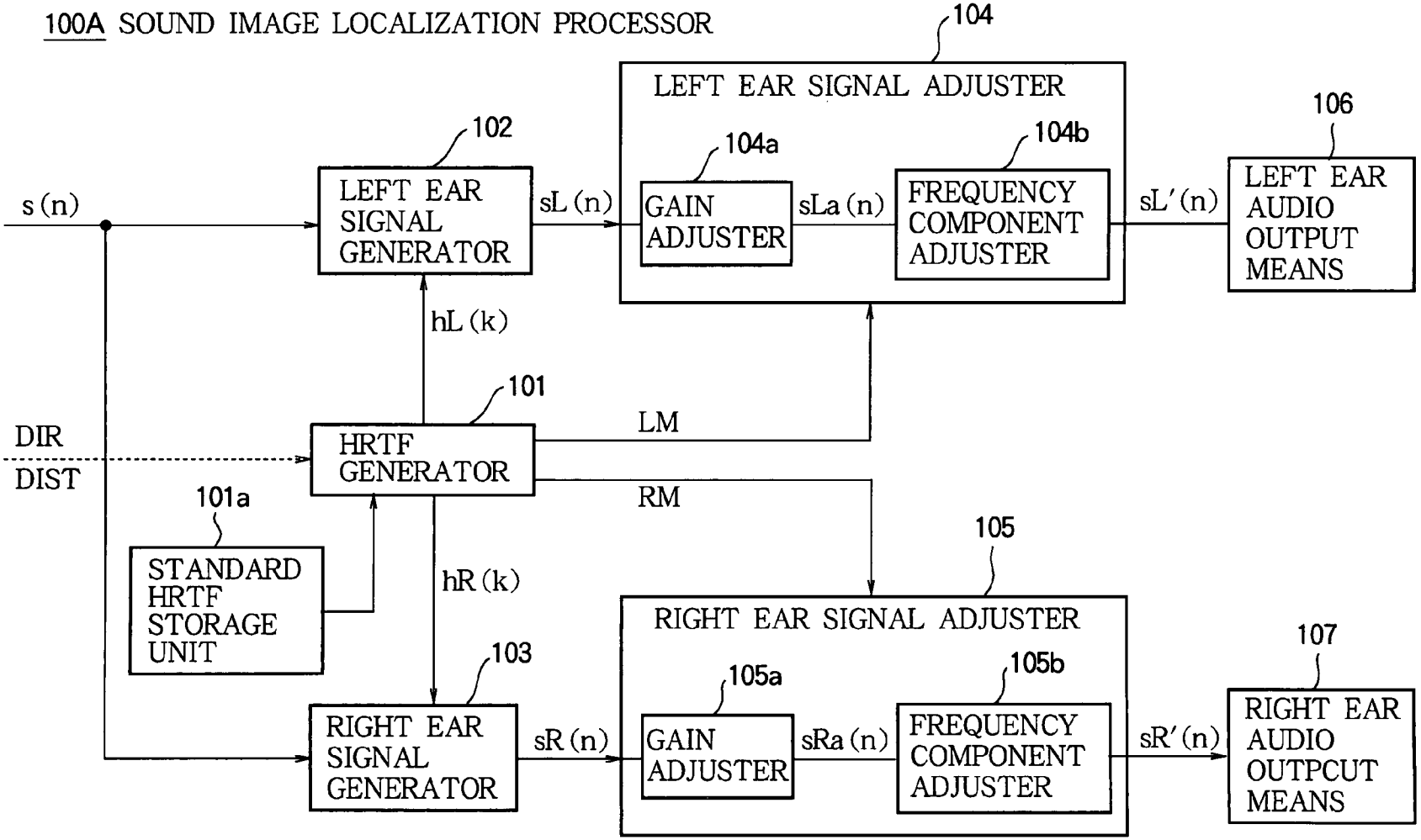
FIG. 5 is a block diagram showing the overall structure of the sound image localization processor in a second embodiment.

FIG. 5 is a block diagram showing the overall structure of the sound image localization processor in the second embodiment; parts identical to or corresponding to parts in the above-described FIG. 1 are indicated by identical or corresponding reference characters.

The sound image localization processor 100A in the second embodiment has a structure in which a frequency component adjuster 104*b* and a frequency component adjuster 105*b* are added to the left ear signal adjuster 104 and right ear signal adjuster 105 of the sound image localization processor 100 in the first embodiment. The differences between the sound image localization processor 100A and the sound image localization processor 100 in the first embodiment will be described below.

A characteristic of sound propagating in real space is that the rate of attenuation per distance increases as the frequency increases. The sound image localization processor 100A in the second embodiment is therefore provided with frequency component adjusters 104*b*, 105*b* capable of performing additional power adjustments on high-frequency components of the signals sL(n), sR(n) following gain adjustment by the gain adjusters 104*a*, 105*a*.

Frequency component adjuster 104*b* adjusts the power of high-frequency components of the gain-adjusted left ear audio listening signal sLa(n) input from gain adjuster 104*a* according to the information LM provided from the HRTF generator 101, and outputs the resulting adjusted left ear audio listening signal as sL'(n) to the left ear audio output means 106.

Frequency component adjuster 105*b* has the same structure as frequency component adjuster 104*b* and similarly adjusts the power of high-frequency components of the gain-adjusted right ear audio listening signal sRa(n) according to the information RM provided from the HRTF generator 101, outputting the resulting adjusted right ear audio listening signal as sR'(n) to the right ear audio output means 107.

Figure 6:
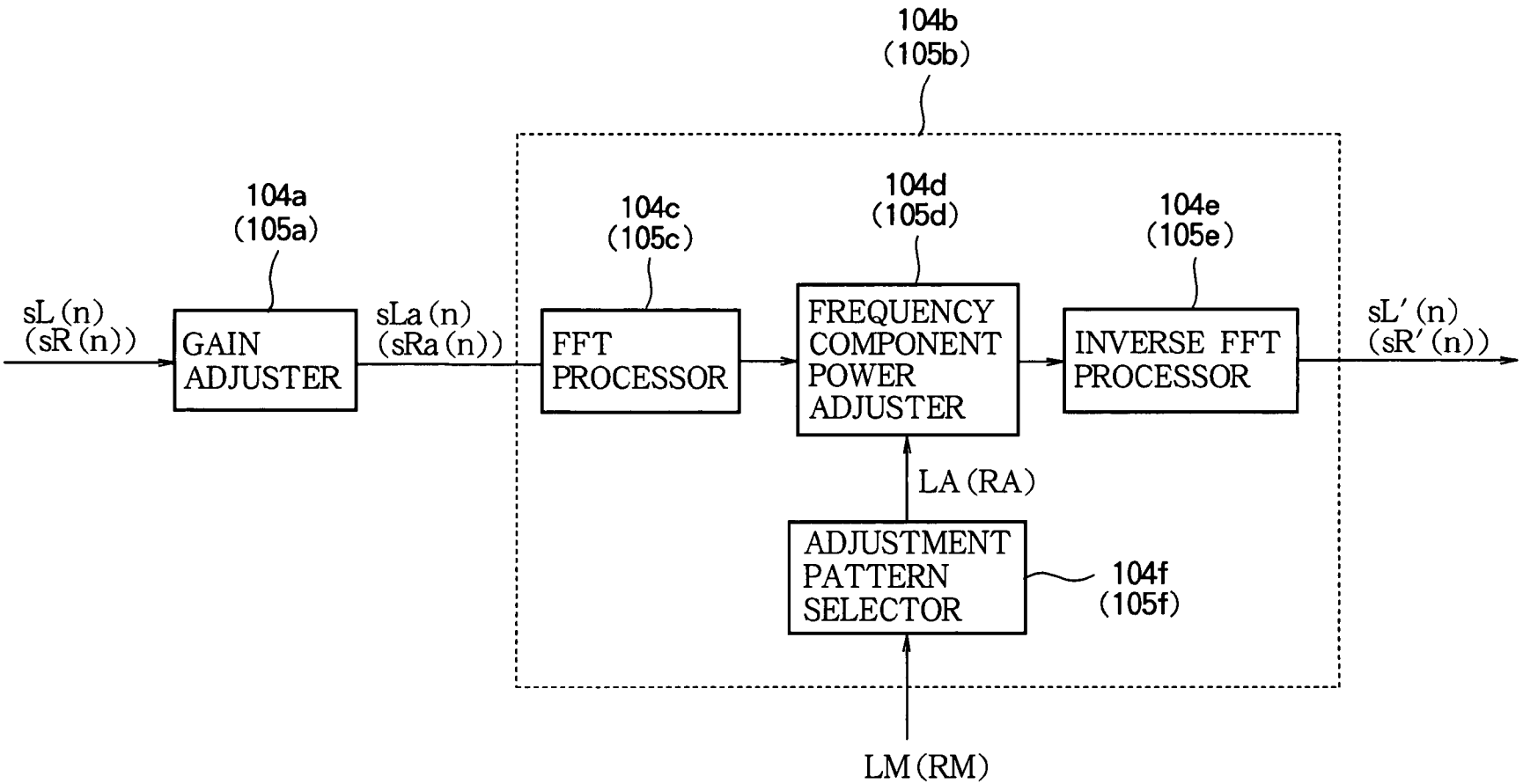
FIG. 6 is a block diagram showing the internal structure of the left ear signal adjuster and the right ear signal adjuster in the second embodiment.

FIG. 6 is a block diagram showing the internal structure of the frequency component adjusters 104*b*, 105*b*.

Frequency component adjuster 104*b* comprises an FFT processor 104*c*, a frequency component power adjuster 104*d*, an inverse FFT processor 104*e*, and an adjustment pattern selector 104*f*. Frequency component adjuster 105*b* comprises an FFT processor 105*c*, a frequency component power adjuster 105*d*, an inverse FFT processor 105*e*, and an adjustment pattern selector 105*f*.

FFT processor 104*c* performs an FFT process on the gain-adjusted left ear audio listening signal sLa(n) input from gain adjuster 104*a* to obtain power information for each frequency component and outputs the result to frequency component power adjuster 104*d*.

Frequency component power adjuster 104*d* adjusts the power information for each frequency component provided from FFT processor 104*c* according to a sense-of-distance adjustment pattern LA provided from adjustment pattern selector 104*f*. Frequency component power adjuster 104*d* may include a sound/silence discriminator and perform these adjustments only when sound is present, or the adjustments may be performed regardless of the presence or absence of sound.

Figure 7A:
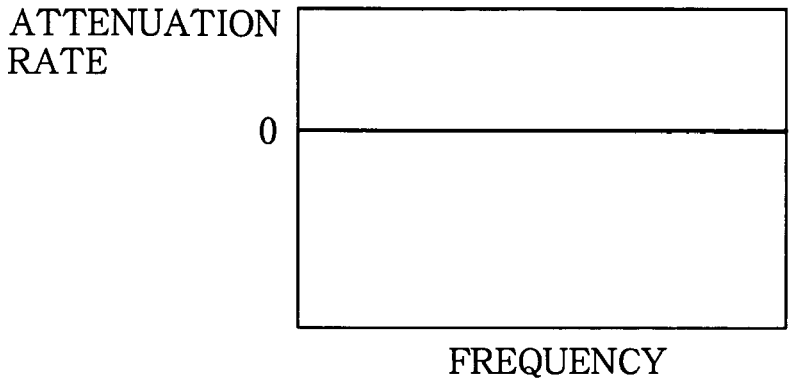
FIGS. 7(A) to 7(C) are explanatory diagrams showing first examples of sense-of-distance adjustment patterns in the second embodiment.
Figure 7B:
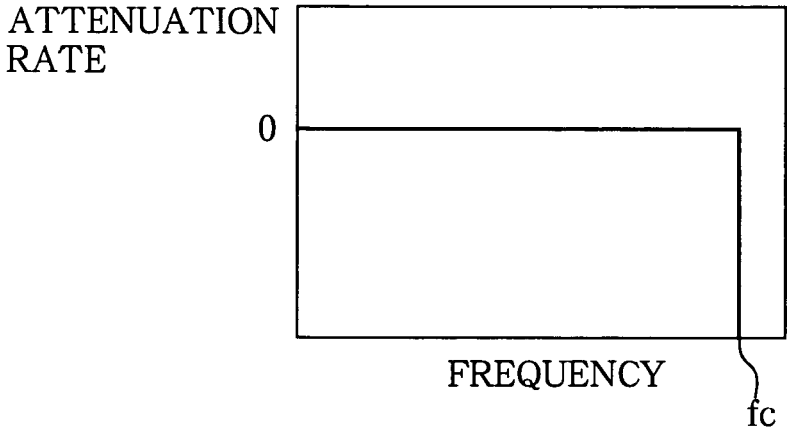
Figure 7C:
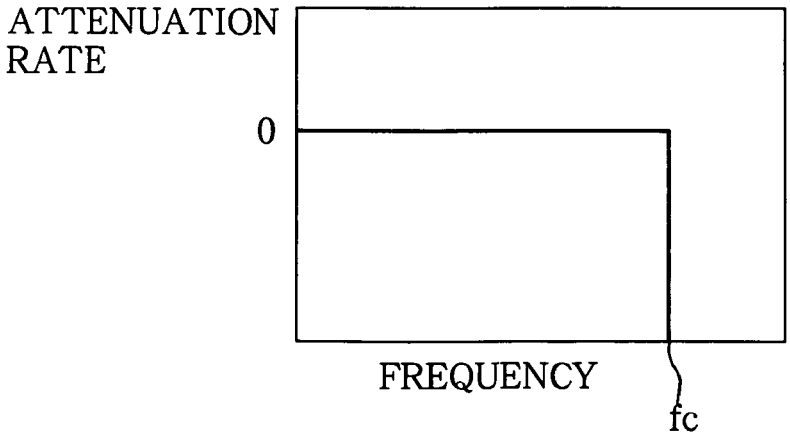
Figure 8A:
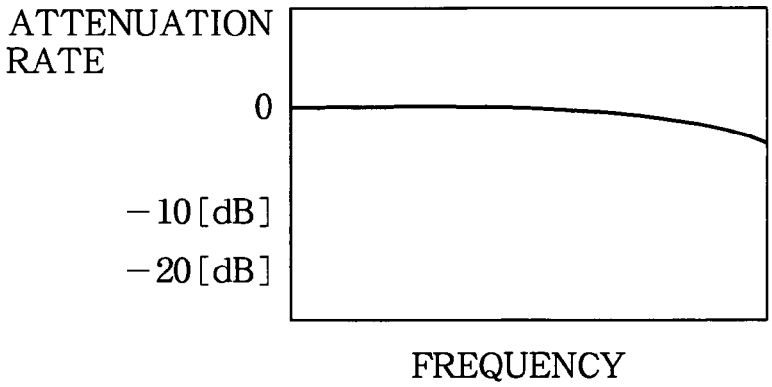
FIGS. 8(A) to 8(C) are explanatory diagrams showing second examples of sense-of-distance adjustment patterns in the second embodiment.
Figure 8B:
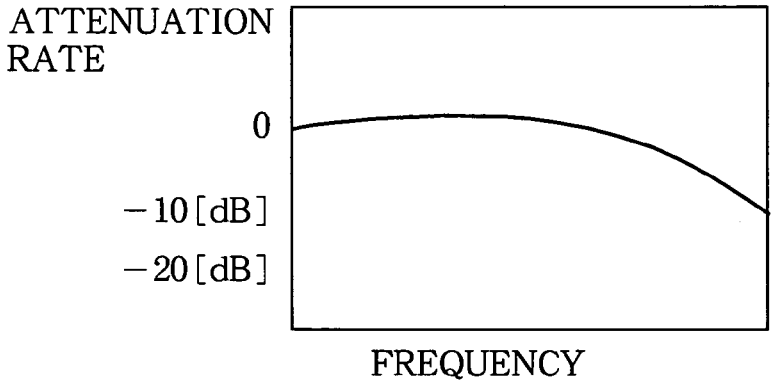
Figure 8C:
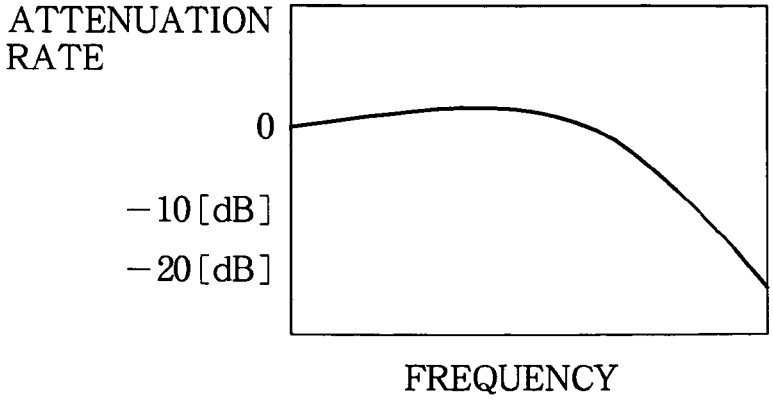

The sense-of-distance adjustment pattern LA provided from adjustment pattern selector 104*f* to frequency component power adjuster 104*d* may have a high-band cutoff frequency fc that is switched as shown in FIGS. 7(A) to 7(C) or an attenuation rate that increases with increasing frequency as shown in FIGS. 8(A) to 8(C). The sense-of-distance adjustment pattern in FIG. 7(B) creates a longer converted distance state than the sense-of-distance adjustment pattern in FIG. 7(A); the sense-of-distance adjustment pattern in FIG. 7(C) creates a longer converted distance state than the sense-of-distance adjustment pattern in FIG. 7(B). The sense-of-distance adjustment pattern in FIG. 8(B) creates a longer converted distance state than the sense-of-distance adjustment pattern in FIG. 8(A); the sense-of-distance adjustment pattern in FIG. 8(C) creates a longer converted distance state than the sense-of-distance adjustment pattern in FIG. 8(B).

Sense-of-distance adjustment patterns LA of the type described above are built into adjustment pattern selector 104*f*, which selects a sense-of-adjustment pattern according to the information LM provided from the HRTF generator 101, retrieves its data, and outputs the data to frequency component power adjuster 104*d*.

The selection of a sense-of-distance adjustment pattern in adjustment pattern selector 104*f* may be carried out, for example, by comparing the distance SLL from the position of the listener's left ear to the sound source point and the distance RLL from the position of the listener's left ear to a position corresponding to the HRTF selected by the HRTF generator 101 and using, for example, the ratio (SLL/RLL) or difference (SLL−RLL) of theses two distances. In this case, as the ratio (SLL/RLL) or the difference (SLL−RLL) increases, a sense-of-distance adjustment pattern that generates a longer distance state should be used.

Although FIGS. 7(A) to 7(C) and FIGS. 8(A) to 8(C) each show three types of sense-of-distance adjustment patterns, more types of patterns may be prepared so that a finer adjustment can be carried out according to the distance.

Inverse FFT processor 104*e* performs an inverse FFT process on the power information for each frequency component, which is provided from frequency component power adjuster 104*d* and in which the sense of distance has been adjusted, and restores the power information to a time-axis signal, which is output to the left ear audio output means 106 as sL'(n).

The FFT processor 105*c*, frequency component power adjuster 105*d*, inverse FFT processor 105*e*, and adjustment pattern selector 105*f* in frequency component adjuster 105*b* have the same structure as the FFT processor 104*c*, frequency component power adjuster 104*d*, inverse FFT processor 104*e*, and adjustment pattern selector 104*f* in frequency component adjuster 104*b*, so descriptions will be omitted.

(B-2) Operation of the Second Embodiment

Next, the audio listening signal adjustment operation of frequency component adjuster 104*b* in the sound image localization processor 100A of the second embodiment having the above structure will be described. The operation of frequency component adjuster 105*b* is substantially the same as the operation of frequency component adjuster 104*b*, so a description will be omitted.

When a gain-adjusted left ear audio listening signal sLa(n) is supplied from gain adjuster 104*a*, FFT processor 104*c* performs an FFT process on the gain-adjusted left ear audio listening signal sLa(n) and outputs power information for each frequency component, which is obtained by the FFT process, to frequency component power adjuster 104*d*.

When the HRTF generator 101 gives adjustment pattern selector 104*f* the information LM necessary for the sense-of-distance adjustment, adjustment pattern selector 104*f* selects a sense-of-distance adjustment pattern according to the given information and outputs it to frequency component power adjuster 104*d*.

When given the power information for each frequency component of the gain-adjusted left ear audio listening signal sLa(n) by FFT processor 104*c* and given the selected sense-of-distance adjustment pattern LA by adjustment pattern selector 104*f*, frequency component power adjuster 104*d* adjusts the given power information for each frequency component according to the given sense-of-distance adjustment pattern and outputs the adjusted power information for each frequency component to inverse FFT processor 104*e*.

When given the sense-of-distance-adjusted power information for each frequency component by frequency component power adjuster 104*d*, inverse FFT processor 104*e* performs an inverse FFT process on the power information for each frequency component received from frequency component power adjuster 104*d* and the left ear audio output means 106 receives the output as sL'(n).

The operation of frequency component adjuster 105*b* is similar to the above.

(B-3) Effect of the Second Embodiment

According to the second embodiment, it is possible to achieve the following effects.

As described above, since sound propagating in real space is characterized by a rate of attenuation per distance that increases with increasing frequency, power adjustments of high-frequency components can be performed on the gain-adjusted signals sL(n), sR(n) by the frequency component adjusters 104*b*, 105*b* to reproduce the above characteristic found in real space by simulation and give a more precise sense of distance than in the first embodiment.

(C) Other Embodiments

The present invention is not limited to the preceding embodiments; the following exemplary variations can also be noted.

(C-1) Even if the given distance DIST is the same in gain adjuster 104*a* and gain adjuster 105*a* in the first embodiment, different gain adjustments may be performed for sL(n) and sR(n). For example, if the listener's left and right ears differ in their hearing capacity, the gain of the listening signal that reaches the ear with the weaker hearing capacity may be greater than the gain for the other ear.

(C-2) In the first embodiment, a single standard HRTF group 220 is stored in the standard HRTF storage unit 101*a* of the HRTF generator 101, but two or more standard HRTF groups may be stored and different standard HRTF groups may be selected and employed according to the direction DIR and distance DIST. For example, a plurality of standard HRTF groups each having a different standard distance may be prepared and the standard HRTFs having the distance closest to distance DIST may be employed. Alternatively, for example, HRTF groups created according to the physical size, hearing capacity, or the like of a plurality of listeners may be prepared on a per-listener basis, a means may be provided by which the listener can select the standard HRTFs to be employed, and the selected HRTF group may be employed.

(C-3) In the first embodiment, the standard HRTF group 220 stored in the standard HRTF storage unit 101*a* of the HRTF generator 101 includes only standard HRTFs corresponding to reference positions on a standard distance circle RC, which is a standard curve in a plane extending in the horizontal direction from the point of view of the listener, but standard HRTFs corresponding to reference positions on a spherical surface centered on the listener and having the standard distance as its radius may be stored. In this case, information describing an angle of elevation or depression from the listener may be added to the direction DIR as information indicating the sound source point and given to the HRTF generator 101, and the HRTF generator 101 may generate (select or calculate) HRTFs from this information. Alternatively, the HRTFs included in the standard HRTF group 220 may correspond to reference positions on an ellipsoid or some other surface other than a perfect sphere. In any case, it is necessary for a plurality of reference positions to be disposed on a reference surface such as the above ellipsoid or perfect sphere. Moreover, a plurality of standard HRTF groups corresponding to reference positions on a plurality of reference surfaces may be stored as noted in variation C-2 above.

(C-4) In each of the above embodiments, the same HRFT group stored in the standard HRTF storage unit 101*a* of the HRTF generator 101 is used for both the left and right ears, but separate groups may be prepared for the left and right ears, taking into consideration the slight difference in position from each reference position to the left and right ears: the left ear HRTF for each reference position is the transfer function of the path from the reference position to the left ear; the right ear HRTF for each reference position is the transfer function of the path from the reference position to the right ear. Alternatively, an HRTF group may be stored in the standard HRTF storage unit 101*a* for only one ear, and the HRTFs for the other ear may be calculated from the stored one-ear HRTF group and employed. One method that may be cited for calculating HRTFs for the other ear is to store only HRTFs for the right ear, and obtain HRTFs for the left ear from right-left symmetry and a standard distance between left and right ears.

(C-5) In the sound image localization processor in the above embodiments, the listener is not limited to a human being, but may be another creature having a sound image localization capability, such as a dog or a cat.

(C-6) The sound image localization processors in the above embodiments are shown as being used in a telephone terminal, but this is not a limitation: the processors may be applied to other sound output devices having a means for outputting sound to a listener based on an audio signal, such as, for example, mobile music players, or may be applied to devices for outputting sound together with images, such as, for example, DVD players.

(C-7) In each of the above embodiments, the left ear signal adjuster 104 and the right ear signal adjuster 105 are situated after the left ear signal generator 102 and the right ear signal generator 103, but they may be situated before the left ear signal generator 102 and the right ear signal generator 103. With this structure, the source audio listening signal s(n) is adjusted to generate sense-of-distance-adjusted or corrected left and right ear audio listening signals sAL(n), sAR(n), which are output to the left ear signal generator 102 and the right ear signal generator 103.

Figure 9:
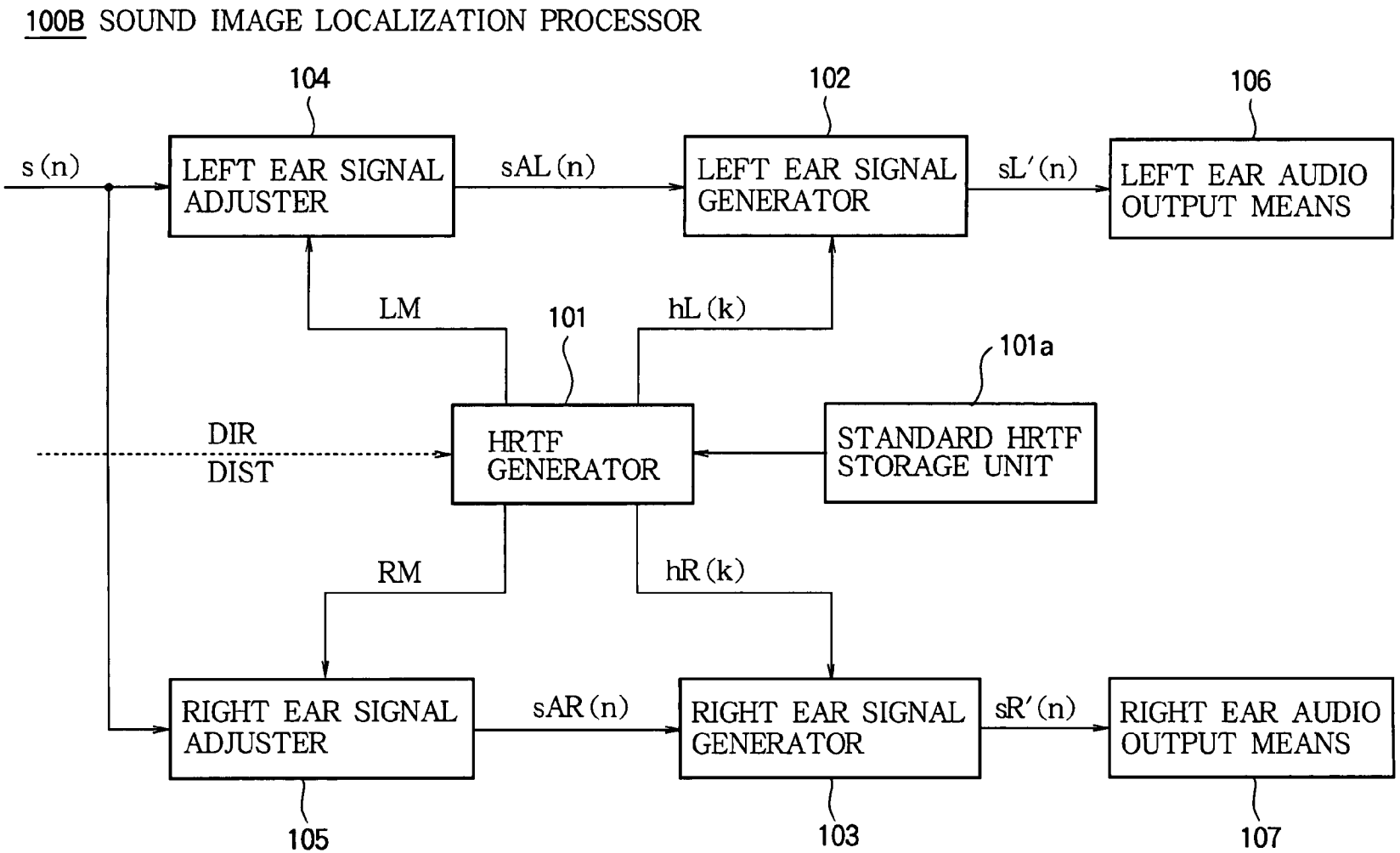
FIG. 9 is a block diagram showing the overall structure of the sound image localization processor in a variation of the first embodiment.

FIG. 9 shows a structure in which such a modification is performed on the sound image localization processor 100 in FIG. 1. In the sound image localization processor 100B shown in FIG. 9, the source audio listening signal s(n) is input to the left ear signal adjuster 104 and the right ear signal adjuster 105. The left ear signal adjuster 104 and right ear signal adjuster 105 adjust the input source audio listening signal s(n) according to respective information LM, RM necessary for signal adjustments, which is provided from the HRTF generator 101, and generate the adjusted left and right ear audio listening signals sAL(n), sAR(n). The left ear signal generator 102 and the right ear signal generator 103 generate adjusted left and right ear audio listening signals sL'(n), sR'(n) according to the adjusted left and right ear audio listening signals sAL(n), sAR(n) and the left and right HRTFs hL(k), hR(k) generated by the HRTF generator 101.

The above modification can also be performed on the sound image localization processor 100B in FIG. 5.

What is claimed is:

1. A sound image localization processor for, when given a source audio listening signal to be listened to by a listener and information about a virtual sound source position referenced to the listener's position, imprinting a sense of direction and a sense of distance on the audio listening signal such that it sounds to the listener as if sound based on the audio listening signal comes from the virtual sound source position, the sound image localization processor comprising:

a standard head related transfer function storage means for storing standard head related transfer functions for a plurality of reference positions located in one or more directions from a virtual listener;

a head related transfer function generation means for, when given the information about the virtual sound source position, forming a left ear head related transfer function for the virtual sound source position by selecting one of the stored standard head related transfer functions or selecting a plurality of the stored standard head related transfer functions and interpolating the plurality of the stored standard head related transfer functions, and for forming a right ear head related transfer function for the virtual sound source by selecting one of the stored standard head related transfer functions or selecting a plurality of the stored standard head related transfer functions and interpolating the plurality of the stored standard head related transfer functions;

a sense-of-direction-and-distance imprinting means for imprinting a sense of direction and distance on the source audio listening signal by using the left ear and right ear head related transfer functions obtained by the head related transfer function generation means; and a sense-of-distance correction means for correcting the sense of distance of a left ear audio listening signal output from the sense-of-direction-and-distance imprinting means or the source audio listening signal input to the sense-of-direction-and-distance imprinting means, according to a first distance from a left ear position to a position corresponding to the left-ear head related transfer function obtained by the head related transfer function generation means and a second distance from the left ear position to the virtual sound source position, and for correcting the sense of distance of a right ear audio listening signal output from the sense-of-direction-and-distance imprinting means or the source audio listening signal input to the sense-of-direction-and-distance imprinting means, according to a third distance from the right ear position to a position corresponding to the right-ear head related transfer function obtained by the head related transfer function generation means and a fourth distance from the right ear position to the virtual sound source position, wherein the sense-of-distance correction means corrects the sense of distance by adjusting a gain of the source audio listening signal, or the left ear audio listening signal and the right ear audio listening signal, according to the first, second, third and fourth distances.

2. The sound image localization processor of claim 1, wherein the plurality of reference positions are disposed on a common reference surface.

3. The sound image localization processor of claim 2, wherein the reference surface is a spherical surface centered on the virtual listener.

4. The sound image localization processor of claim 3, wherein the head related transfer function generation means generates, as the left-ear head related transfer function, a standard head related transfer function for a reference position disposed at a point of intersection of the reference surface and a line passing through the position of the listener's left ear and the virtual sound source position, a standard head related transfer function for a reference position disposed in a neighborhood of said point of intersection, or a head related transfer function obtained by interpolation from a plurality of standard head related transfer functions for reference positions disposed in the neighborhood of said point of intersection, and generates, as the right-ear head related transfer function, a standard head related transfer function for a reference position disposed at a point of intersection of the reference surface and a line passing through the position of the listener's right ear and the virtual sound source position, a standard head related transfer function for a reference position disposed in a neighborhood of said point of intersection, or a head related transfer function obtained by interpolation from a plurality of standard head related transfer functions for reference positions disposed in the neighborhood of said point of intersection.

5. The sound image localization processor of claim 3, wherein the sense-of-distance correction means corrects the sense of distance by adjusting a gain of the source audio listening signal, or the left ear audio listening signal and the right ear audio listening signal.

6. The sound image localization processor of claim 5, wherein the sense-of-distance correction means corrects the sense of distance by performing a power adjustment of a high-frequency component in the source audio listening signal, or the left ear audio listening signal and the right ear audio listening signal.

7. The sound image localization processor of claim 2, wherein the head related transfer function generation means generates, as the left-ear head related transfer function, a standard head related transfer function for a reference position disposed at a point of intersection of the reference surface and a line passing through the position of the listener's left ear and the virtual sound source position, a standard head related transfer function for a reference position disposed in a neighborhood of said point of intersection, or a head related transfer function obtained by interpolation from a plurality of standard head related transfer functions for reference positions disposed in the neighborhood of said point of intersection, and generates, as the right-ear head related transfer function, a standard head related transfer function for a reference position disposed at a point of intersection of the reference surface and a line passing through the position of the listener's right ear and the virtual sound source position, a standard head related transfer function for a reference position disposed in a neighborhood of said point of intersection, or a head related transfer function obtained by interpolation from a plurality of standard head related transfer functions for reference positions disposed in the neighborhood of said point of intersection.

8. The sound image localization processor of claim 7, wherein the sense-of-distance correction means corrects the sense of distance by adjusting a gain of the source audio listening signal, or the left ear audio listening signal and the right ear audio listening signal.

9. The sound image localization processor of claim 8, wherein the sense-of-distance correction means corrects the sense of distance by performing a power adjustment of a high-frequency component in the source audio listening signal, or the left ear audio listening signal and the right ear audio listening signal.

10. The sound image localization processor of claim 2, wherein the sense-of-distance correction means corrects the sense of distance by adjusting a gain of the source audio listening signal, or the left ear audio listening signal and the right ear audio listening signal.

11. The sound image localization processor of claim 10, wherein the sense-of-distance correction means corrects the sense of distance by performing a power adjustment of a high-frequency component in the source audio listening signal, or the left ear audio listening signal and the right ear audio listening signal.

12. The sound image localization processor of claim 1, wherein the sense-of-distance correction means corrects the sense of distance by performing a power adjustment of a high-frequency component in the source audio listening signal, or the left ear audio listening signal and the right ear audio listening signal according to the first, second, third and fourth distances.

13. The sound image localization processor of claim 1, wherein:

the sense-of-direction-and-distance imprinting means generates the left ear audio listening signal and the right ear audio listening signal by imprinting a sense of direction and distance on the source audio listening signal based on the head related transfer functions from the head related transfer function generation means; and the sense-of-distance correction means corrects the sense of distance of the left ear audio listening signal and the right ear audio listening signal output from the sense-of-direction-and-distance imprinting means.

14. The sound image localization processor of claim 1, wherein:

the sense-of-distance correction means corrects the sense of distance for the source audio listening signal to generate audio listening signals for the left ear and the right ear in which the sense of distance is corrected; and the sense-of-direction-and-distance imprinting means imprints a sense of direction and distance based on the head related transfer functions from the head related transfer function generation means on the audio listening signals for the left ear and the right ear in which the sense of distance is corrected to generate a left ear audio listening signal in which the sense of distance is corrected and a right ear audio listening signal in which the sense of distance is corrected.

15. The sound image localization processor of claim 1, wherein the sense-of-distance correction means corrects the sense of distance by adjusting a gain of the source audio listening signal, or the left ear audio listening signal and the right ear audio listening signal.

16. The sound image localization processor of claim 15, wherein the sense-of-distance correction means corrects the sense of distance by performing a power adjustment of a high-frequency component in the source audio listening signal, or the left ear audio listening signal and the right ear audio listening signal.

17. A sound image localization processing program for, when given a source audio listening signal to be listened to by a listener and information about a virtual sound source position referenced to the listener's position, imprinting a sense of direction and a sense of distance on the audio listening signal such that it sounds to the listener as if sound based on the audio listening signal comes from the virtual sound source position, by making a computer furnished with sound output apparatus function as:

a standard head related transfer function storage means for storing standard head related transfer functions for a plurality of reference positions located in one or more directions from a virtual listener;

a head related transfer function generation means for, when given the information about the virtual sound source position, forming a left ear head related transfer function for the virtual sound source position by selecting one of the stored standard head related transfer functions or selecting a plurality of the stored standard head related transfer functions and interpolating the plurality of the stored standard head related transfer functions, and for forming a right ear head related transfer function for the virtual sound source by selecting one of the stored standard head related transfer functions or selecting a plurality of the stored standard head related transfer functions and interpolating the plurality of the stored standard head related transfer functions;

a sense-of-direction-and-distance imprinting means for imprinting a sense of direction and distance on the source audio listening signal by using the left ear and right ear head related transfer functions obtained by the head related transfer function generation means; and a sense-of-distance correction means for correcting the sense of distance of a left ear audio listening signal output from the sense-of-direction-and-distance imprinting means or the source audio listening signal input to the sense-of-direction-and-distance imprinting means, according to a first distance from a left ear position to a position corresponding to the left-ear head related transfer function obtained by the head related transfer function generation means and a second distance from the left ear position to the virtual sound source position, and for correcting the sense of distance of a right ear audio listening signal output from the sense-of-direction-and-distance imprinting means or the source audio listening signal input to the sense-of-direction-and-distance imprinting means, according to a third distance from the right ear position to a position corresponding to the right-ear head related transfer function obtained by the head related transfer function generation means and a fourth distance from the right ear position to the virtual sound source position, wherein the sense-of-distance correction means corrects the sense of distance by adjusting a gain of the source audio listening signal, or the left ear audio listening signal and the right ear audio listening signal, according to the first, second, third and fourth distances.

18. A sound image localization processing method for, when given a source audio listening signal to be listened to by a listener and information about a virtual sound source position referenced to the listener's position, imprinting a sense of direction and a sense of distance on the audio listening signal such that it sounds to the listener as if sound based on the audio listening signal comes from the virtual sound source position, the sound image localization method comprising:

storing, by a standard head related transfer function storage means, standard head related transfer functions for a plurality of reference positions located in one or more directions from a virtual listener;

when given the information about the virtual sound source position, forming, by a head related transfer function generation means, a left ear head related transfer function for the virtual sound source position by selecting one of the stored standard head related transfer functions or selecting a plurality of the stored standard head related transfer functions and interpolating the plurality of the stored standard head related transfer functions, and forming a right ear head related transfer function for the virtual sound source by selecting one of the stored standard head related transfer functions or selecting a plurality of the stored standard head related transfer functions and interpolating the plurality of the stored standard head related transfer functions;

imprinting, by a sense-of-direction-and-distance imprinting means, a sense of direction and distance on the source audio listening signal by using the left ear and right ear head related transfer functions obtained by the head related transfer function generation means; and by a sense-of-distance correction means, correcting the sense of distance of a left ear audio listening signal output from the sense-of-direction-and-distance imprinting means or the source audio listening signal input to the sense-of-direction-and-distance imprinting means, according to a first distance from a left ear position to a position corresponding to the left-ear head related transfer function obtained by the head related transfer function generation means and a second distance from the left ear position to the virtual sound source position, and correcting the sense of distance of a right ear audio listening signal output from the sense-of-direction-and-distance imprinting means or the source audio listening signal input to the sense-of-direction-and-distance imprinting means, according to a third distance from the right ear position to a position corresponding to the right-ear head related transfer function obtained by the head related transfer function generation means and a fourth distance from the right ear position to the virtual sound source position, wherein the sense-of-distance correction means corrects the sense of distance by adjusting a gain of the source audio listening signal, or the left ear audio listening signal and the right ear audio listening signal, according to the first, second, third and fourth distances.

19. The sound image localization processing method of claim 18, further comprising correcting the sense of distance by performing a power adjustment of a high-frequency component in the source audio listening signal, or the left ear audio listening signal and the right ear audio listening signal according to the first, second, third and fourth distances.

* * * * *